US007507073B2

(12) United States Patent
Burdgick et al.

(10) Patent No.: US 7,507,073 B2
(45) Date of Patent: Mar. 24, 2009

(54) METHODS AND APPARATUS FOR ASSEMBLING A STEAM TURBINE BUCKET

(75) Inventors: Steven Sebastian Burdgick, Schenectady, NY (US); Adegboyega Masud Makinde, Niskayuna, NY (US); Christophe Marcel Lanaud, Delanson, NY (US)

(73) Assignee: General Electric Company, Schenectady, NY (US)

( * ) Notice: Subject to any disclaimer, the term of this patent is extended or adjusted under 35 U.S.C. 154(b) by 38 days.

(21) Appl. No.: 11/362,302

(22) Filed: Feb. 24, 2006

(65) Prior Publication Data

US 2009/0022599 A1 Jan. 22, 2009

(51) Int. Cl.
*F01D 5/28* (2006.01)

(52) U.S. Cl. ..... 416/229 A; 416/241 A; 29/889.71

(58) Field of Classification Search ..... 416/223 A, 416/223 R, 229 A, 229 R, 230, 236 R, 241 A, 416/500; 29/888.024, 888.025, 889.7, 889.71
See application file for complete search history.

(56) References Cited

U.S. PATENT DOCUMENTS

| | | | | |
|---|---|---|---|---|
| 5,383,766 | A * | 1/1995 | Przirembel et al. | 416/97 A |
| 5,720,597 | A | 2/1998 | Wang et al. | |
| 5,791,879 | A | 8/1998 | Fitzgerald et al. | |
| 5,931,641 | A | 8/1999 | Finn et al. | |
| 6,139,278 | A | 10/2000 | Mowbray et al. | |
| 6,832,889 | B1 * | 12/2004 | Lee et al. | 415/115 |
| 6,854,959 | B2 | 2/2005 | Barb | |
| 7,024,744 | B2 | 4/2006 | Martin et al. | |
| 7,104,760 | B2 | 9/2006 | Burdgick | |
| 7,104,761 | B2 | 9/2006 | Burdgick et al. | |
| 7,147,437 | B2 | 12/2006 | Burdgick et al. | |

* cited by examiner

*Primary Examiner*—Igor Kershteyn
(74) *Attorney, Agent, or Firm*—Armstrong Teasdale LLP

(57) ABSTRACT

A method of assembling a turbine bucket is provided. The bucket includes a dovetail portion, an airfoil portion, and a root that extends between the airfoil portion and the dovetail portion. The turbine bucket includes a pressure side and a suction side that are connected together at a leading edge and a trailing edge. The method includes forming at least one pocket within the turbine bucket, such that the pocket is formed within the pressure side. The method also includes forming at least one pin within the at least one pocket.

19 Claims, 5 Drawing Sheets

METHODS AND APPARATUS FOR ASSEMBLING A STEAM TURBINE BUCKET

BACKGROUND OF THE INVENTION

This invention relates generally to steam turbines and, more particularly, to methods and apparatus for assembling low pressure (LP) turbine long buckets (or blades).

During operation, turbine buckets are exposed to centrifugal loads, which may cause fatigue in the bucket and/or premature failure. Centrifugal loading may be a function of bucket operating speed, a weight of the bucket, and a location of the bucket relative to an engine centerline. As such, one known method of increasing the turbine bucket lifespan includes reducing the weight of the bucket. Additionally, the use of a hybrid bucket design allows for longer last stage buckets that equate to steam turbine output as the area increases. Moreover, the hybrid construction generally allows for more aerodynamic (wider chord) airfoils that facilitate improving stage efficiency. Lastly, the hybrid construction creates damping in the bucket/stage thereby improving the frequency response of the stage thereby improving reliability.

For turbine buckets, centrifugal loads are at least partially a function of the operating speed, the mass of the blade, and the local radius from an engine centerline to where the blade mass is located. As such, as the mass of the blade increases, the physical area or cross-sectional area must be increased at lower radial heights to enable the blade to carry the increased mass without exceeding the allowable stresses for the given material. However, the increased area of the blade at the lower spans contributes to excessive flow blockage at the root and thus may reduce performance. Moreover, the increased weight of the blade contributes to higher disk stresses and thus may reduce reliability of the turbine bucket.

In at least some known turbine bucket designs, the weight of the bucket is reduced by fabricating the bucket with hollow pockets which are then filled with a composite or polymer material. The pockets reduce the weight of the bucket while the fill material facilitates maintaining the profile and/or strength of the bucket. However, such designs often lack sufficient adhesive bonds between the metal of the turbine bucket and the composite material. Specifically, composites capable of withstanding the engine's high temperatures generally adhere poorly to the bucket metal because the composite material weighs more than a polymer filler material. Furthermore, centrifugal loading in the buckets may create shear stresses on adhesive surfaces extending between the metal and the fill material. As a result, over time, centrifugal loading may cause the bucket metal to separate from the fill material which may cause the bucket to fail and/or may reduce the turbine output as the aerodynamic performance is compromised.

BRIEF DESCRIPTION OF THE INVENTION

In one aspect, a method of assembling a turbine bucket is provided. The bucket includes a dovetail portion, an airfoil portion, and a root that extends between the airfoil portion and the dovetail portion. The turbine bucket includes a pressure side and a suction side that are connected together at a leading edge and a trailing edge. The method includes forming at least one pocket within the turbine bucket, such that the pocket is formed within the pressure side. The method also includes forming at least one pin within the at least one pocket.

In another aspect, a bucket for a steam turbine is provided. The bucket includes a dovetail portion, an airfoil portion, and a root extending between the dovetail portion and the airfoil portion. The airfoil portion includes a first surface and a second surface connected together at a leading edge and a trailing edge. One of the first surface and the second surface includes at least one pocket defined therein, and at least one pin is formed within the at least one pocket.

In a further aspect, a steam engine is provided. The steam engine includes at least one bucket further including dovetail portion, an airfoil portion, and a root extending between the dovetail portion and the airfoil portion. The airfoil portion includes a first surface and a second surface connected together at a leading edge and a trailing edge. One of the first surface and the second surface includes at least one pocket defined therein. At least one pin is formed within the at least one pocket.

DETAILED DESCRIPTION OF THE INVENTION

Figure 1:
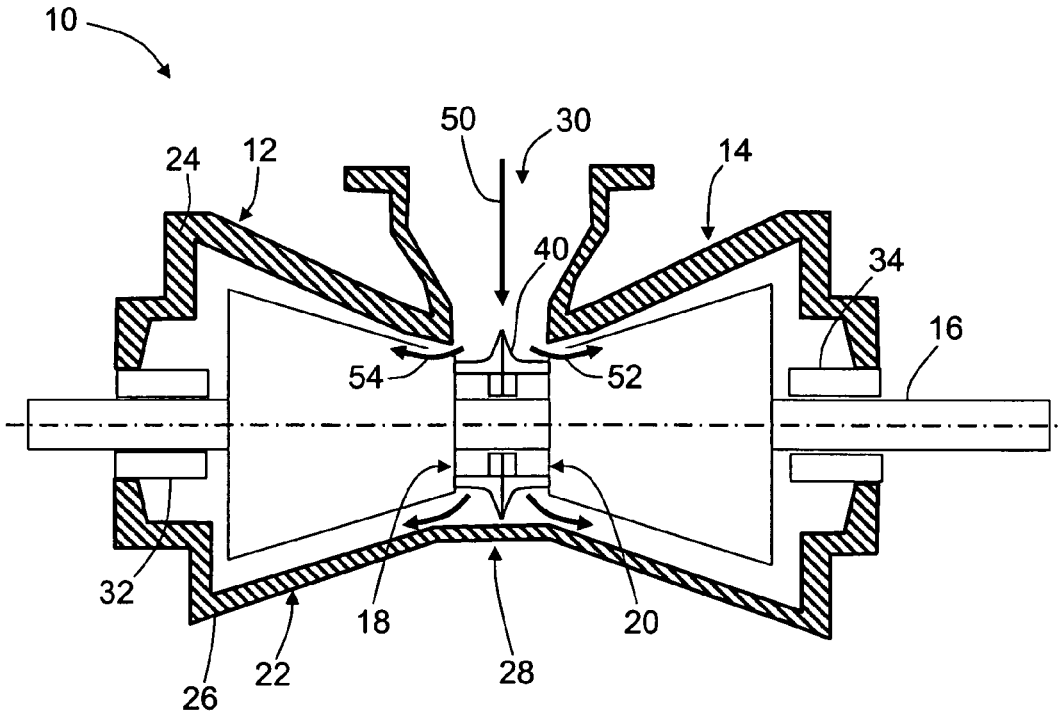
FIG. 1 is a schematic illustration of an exemplary opposed flow, or double flow, low pressure steam turbine.

FIG. 1 is a schematic illustration of an exemplary opposed-flow, low-pressure (LP) steam turbine 10. Turbine 10 includes first and second low pressure sections 12 and 14. As is known in the art, each turbine section 12 and 14 includes a plurality of stages of diaphragms (not shown in FIG. 1). A rotor shaft 16 extends through sections 12 and 14. Each LP section 12 and 14 includes a nozzle 18 and 20. A single outer shell or casing 22 is divided along a horizontal plane and axially into upper and lower half sections 24 and 26, respectively, and spans both LP sections 12 and 14. A central section 28 of shell 22 includes a low pressure steam inlet 30. Within outer shell or casing 22, LP sections 12 and 14 are arranged in a single bearing span supported by journal bearings 32 and 34. A flow splitter 40 extends between first and second turbine sections 12 and 14.

Figure 2:
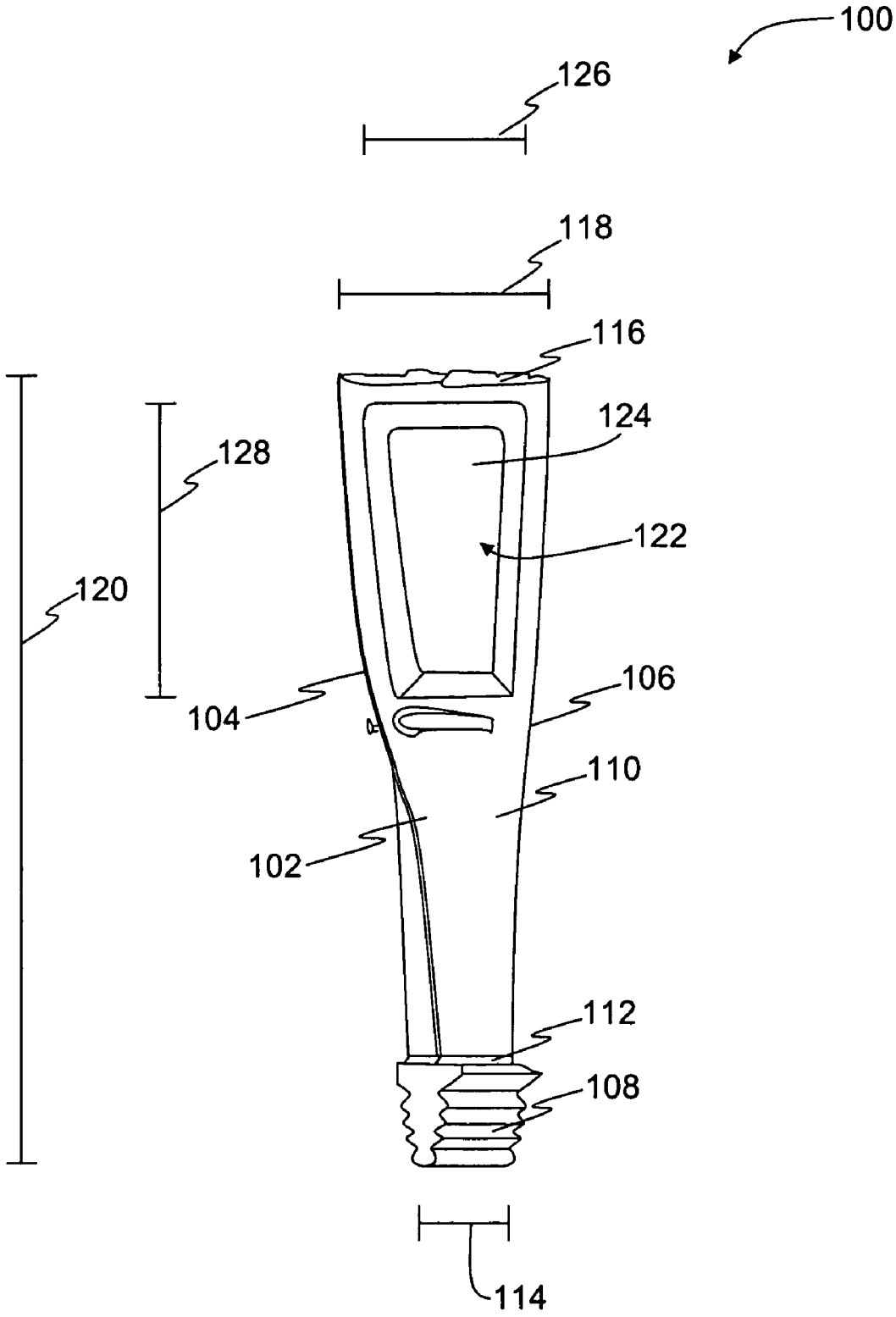
FIG. 2 is a perspective view of an exemplary steam turbine low-pressure bucket that may be used with the steam turbine shown in FIG. 1.

FIG. 2 is a perspective view of a steam turbine LP long bucket 100 used with turbine 10 (shown in FIG. 1). Turbine bucket 100 includes a pressure side 102 and a suction side (not shown in FIG. 2) connected together at a leading edge 104 and a trailing edge 106. Pressure side 102 is generally concave and the suction side is generally convex. Turbine bucket 100 includes a dovetail 108, an airfoil portion 110, and a root 112 extending therebetween. In the exemplary embodiment, airfoil portion 110 and root 112 are fabricated from one unitary piece and are coupled to dovetail 108. In an alternative embodiment, airfoil portion 110, root 112, and dovetail 108 may all be fabricated as a unitary component. In the exemplary embodiment, bucket 100 couples to rotor shaft 16 via dovetail 108 and extends radially outward from rotor shaft 16. In an alternative embodiment, bucket 100 may be coupled to rotor shaft 16 by other devices configured to couple a bucket to a rotor shaft, such as, a blisk.

Bucket dovetail 108 has a length 114 that facilitates securing bucket 100 to rotor shaft 16. As rotor shaft 16 may vary in size, length 114 may also vary to facilitate providing optimal performance of bucket 100 and, more specifically, turbine 10. Root 112 extends radially outward from dovetail 108 and has a length that is approximately equal to dovetail length 114. Airfoil portion 110 extends radially outward from root 112 and also has an initial length that is approximately equal to dovetail length 114. Notably, in the exemplary embodiment, root 112 and airfoil portion 110 are fabricated unitarily together such that there are no seams or inconsistencies in bucket 100 where root 112 transitions to airfoil portion 110.

Airfoil portion 110 extends radially outward from root 112 and increases in length to a tip 116 of bucket 100. In the exemplary embodiment, tip 116 has a length 118 that is longer than length 114. Airfoil portion 110 also has a width (not shown) sized to facilitate locking a snub cover (not shown). As such, tip length 118 and the tip width may vary depending on the application of bucket 100 and, more specifically, turbine 10. Bucket 100 has a radial length 120 measured from dovetail 108 to tip 116. Length 120 is selected to facilitate optimizing performance of bucket 100. As such, bucket length 120 may also vary depending on the application of bucket 100 and, more specifically, turbine 10.

In the exemplary embodiment, bucket 100 also includes a pocket 122 defined within airfoil portion 110. Alternatively, airfoil portion 110 may include more than one pocket 122. Pocket 122 is formed with a bottom surface 124 that is recessed from pressure side 102 of airfoil portion 110. Alternatively, pocket 122 may be formed with a bottom surface 124 that is recessed from the suction side (not shown in FIG. 2). In the exemplary embodiment, pocket 122 is substantially rectangular and has a width 126 and a length 128. Alternatively, as is known in the art, pocket 122 may be formed with any cross-sectional shape that enables bucket 100 to function as described herein. Width 126 and length 128 are selected to ensure that pocket 122 is circumscribed by pressure side 102. In other embodiments, although pocket 122 may be shaped differently, in each configuration, pocket 122 is circumscribed by pressure side 102. The shape of pocket 122 is selected to facilitate optimizing performance of bucket 100.

Figure 3:
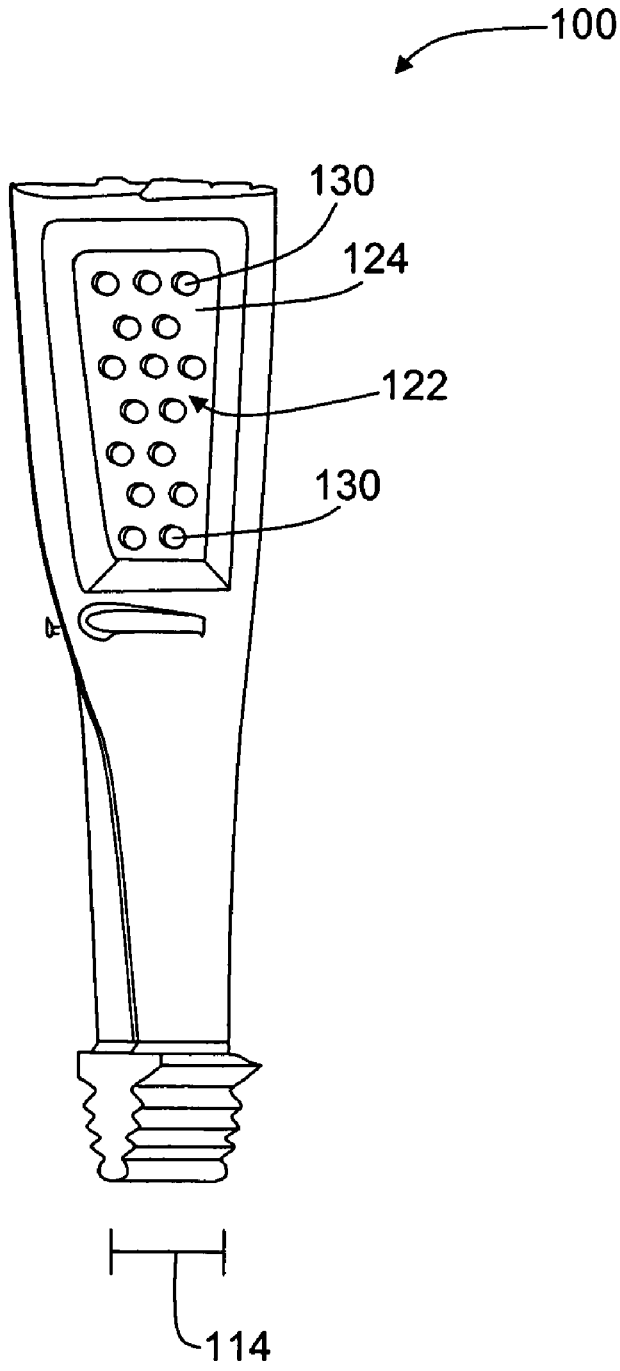
FIG. 3 is a perspective view of the turbine bucket shown in FIG. 2 and including a plurality of pins positioned within the airfoil of the bucket.

FIG. 3 is a perspective view of turbine bucket 100 including a plurality of pins 130 disposed within airfoil pocket 122. Specifically, in the exemplary embodiment, pins 130 extend from pocket bottom surface 124 outward towards pressure side 102. Generally pins 130 and pocket 122 are machined as one unitary piece, however, in an alternative embodiment, pins 130 may be inserted into pocket 122 after pocket 122 has been machined.

In the exemplary embodiment bucket 100 includes sixteen pins 130. Alternatively, bucket 100 may include more or less pins 130. The number of pins 130 is variably selected depending on an operating temperature of turbine 10 and on the material properties of a fill material (not shown in FIG. 3) used to fill pocket 122. Furthermore, the dimensions of pins 130 and the relative orientation and positioning of pins 130 within pocket 122, and with respect to other pins 130, may vary depending on the operating temperature of turbine 10 and the material properties of the fill material. Moreover, in the exemplary embodiment, pins 130 are fabricated in a tubular shape, however, in other embodiments, pins 130 may have any other shape that enables pins 130 to function as described herein.

Figure 4:
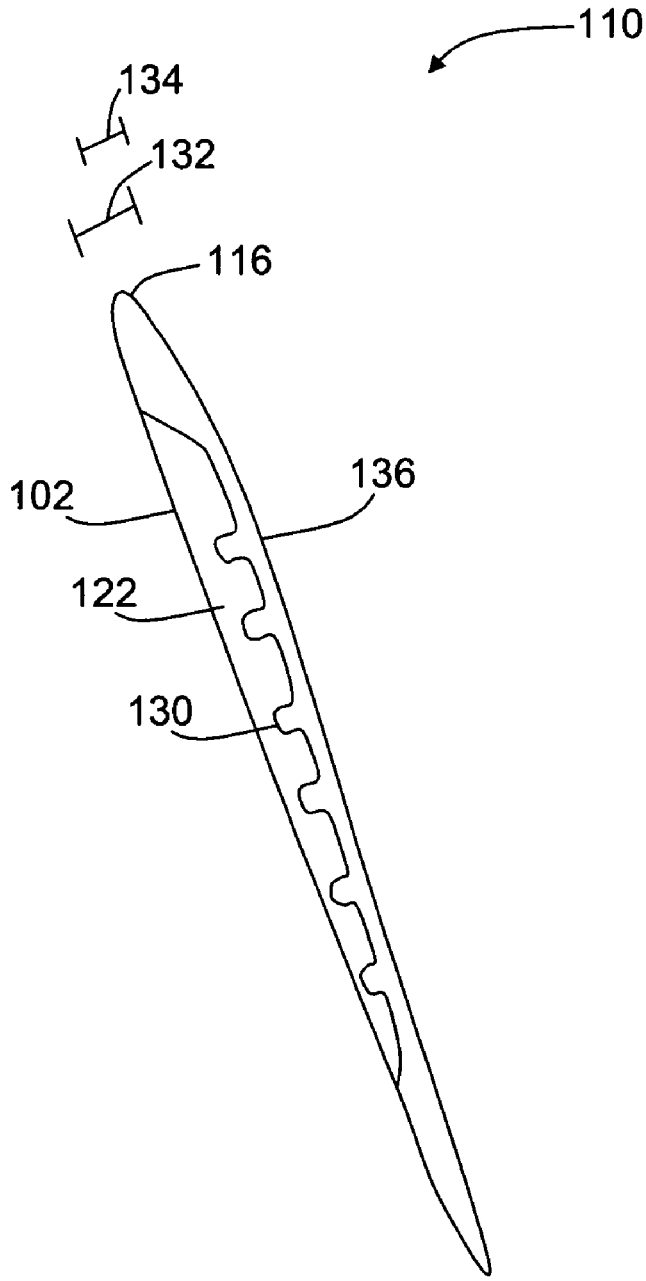
FIG. 4 is a cross-sectional side view of the airfoil shown in FIG. 3.

FIG. 4 is a cross-sectional side view of a portion of airfoil portion 110. In the exemplary embodiment, pocket 122 is formed at a depth 132, which gradually tapers toward a tip 116 of airfoil portion 110. Alternatively, pocket 122 may be formed with a substantially constant depth 132. Pocket depth 132 is selected to facilitate reducing a weight of bucket 100 while maintaining the structural integrity of bucket 100. In one embodiment, pocket 122 includes an undercut edge configured to facilitate improving fill material containment and load transfer. The undercut edge further facilitates improving an edge adhesion and improving lifting at leading edge 104 due to a steam flow angle relative to the airfoil.

In the exemplary embodiment, pins 130 each have a height 134 less than depth 132. As such, pins 130 do not extend outward beyond pressure side 102. In an alternative embodiment, pocket 122 may be formed within a suction side 136. In the alternative embodiment, pins 130 would not extend outward beyond suction side 136. In the exemplary embodiment, each pin 130 has substantially the same height 134. In alternative embodiments, pins 130 may be formed with different heights 134. The size, shape, and configuration of pins 130 may vary depending on a desired engine performance, but in each embodiment, pins 130 will have a height 134 that is shorter than depth 132. As such, in each embodiment, pins 130 will be surrounded by, and covered by, the fill material. In one embodiment, pins 130 also include undercut edges to facilitate improving adhesion and improving loading between the fill material and airfoil portion 10.

Figure 5:
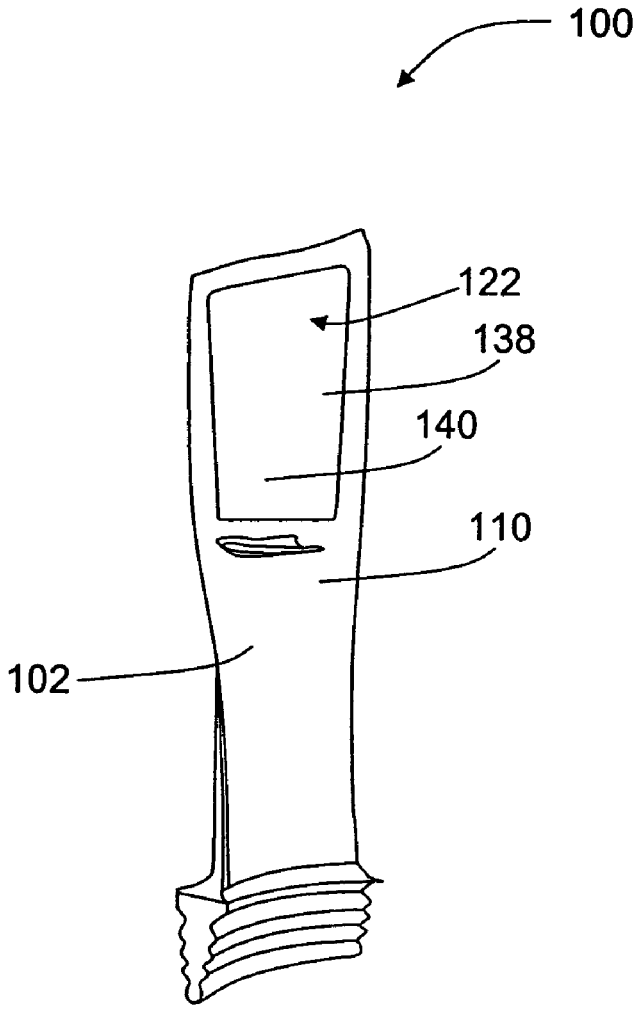
FIG. 5 is a perspective view of the bucket shown in FIG. 3 and including a fill material formed within the airfoil shown in FIG. 3.

FIG. 5 is a perspective view of airfoil portion 110 including a fill material 138 formed within pocket 122. In the exemplary embodiment, fill material 138 is fabricated with a matrix of fibers. Fill material 138 is disposed within pocket 122 such that an outer surface 140 of fill material 138 extends along the same aerodynamic contour of pressure side 102. Furthermore, fill material 138 is disposed within pocket 122 such that pins 130 (shown in FIGS. 3 and 4) are both surrounded by, and covered by, fill material 138. In the exemplary embodiment, fill material 138 is a composite material that may include any of, but is not limited to including, a polyimide material, a polymeric resin material including glass fibers, a carbon material structure, and/or organic fibers produced from polyparaphenylene terephthalamide materials, such as Kevlar®. In an alternative embodiment, fill material 138 may be a polymer material and/or a foam material.

During operation, centrifugal forces acting on bucket 100 may cause fatigue and/or failure within bucket 100. Reducing the weight of bucket 100 facilitates limiting failure and fatigue being induced in bucket 100, and, in-turn, facilitates increasing the lifespan of bucket 100. Pocket 122 also facilitates reducing the weight of bucket 100 by reducing an amount of metal present in bucket 100 and by replacing the metal with a lighter weight fill material 138. Specifically, the amount of fill material 138 weighs less than the amount of airfoil metal used to fabricate airfoil portion 110. As such, bucket 100 can be fabricated with a lighter overall weight without adversely affecting the aerodynamic profile or structural integrity of bucket 100.

Fill material 138 is positioned within pocket 122 such that each pin 130 is surrounded by, and covered by, fill material 138. Pins 130 facilitate adhering fill material 138 within pocket 122. In particular, pins 130 facilitate enhancing a bond between fill material 138 and pocket 122 and facilitate increasing an adhesion area for fill material 138 within pocket 122. The increased adhesion area facilitates distributing shear stresses induced to airfoil pocket 122. As such, pins 130 reduce the effect of shear stresses induced to pocket 122 and thus facilitate preventing fill material 138 from separating from pocket 122.

Moreover, fill material 138 is variably selected based on several factors, including but not limited to, the operating temperature of turbine 10. In addition, the number, size, and arrangement of pins 130 are variably selected based on a number of factors including the turbine operating temperature. Specifically, the selection of fill material 138 and the exact configuration of pins 130 may vary depending on the configuration of turbine 10 and the desired optimal performance of turbine 10. In each embodiment, pins 130 facilitate distributing stresses and facilitate increasing adhesion with both low temperature and high temperature fill materials 138. Furthermore, the pin arrangement facilitates improving frequency damping characteristics of bucket 100, thereby facilitating improving a reliability and cycle time of bucket 100.

The above-described method and apparatus facilitates reducing the weight of a turbine bucket while also maintaining the aerodynamic profile and structural integrity of bucket. Specifically the pins provide a shear area for distributing the fill material load into the airfoil. The distribution of shear stress reduces the adhesion stress between the fill material and the airfoil during the high centrifugal loading present during turbine operation. Accordingly, the reduced adhesion stress facilitates preventing the fill material from separating from the pocket. As such fatigue and failure within the turbine bucket is decreased.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

Although the methods and systems described herein are described in the context of fabricating a turbine bucket for a turbine engine, it is understood that the methods and systems described herein are not limited to turbine buckets or turbine engines. Likewise, the turbine bucket components illustrated are not limited to the specific embodiments described herein, but rather, components of the turbine bucket can be utilized independently and separately from other components described herein.

While the invention has been described in terms of various specific embodiments, those skilled in the art will recognize that the invention can be practiced with modification within the spirit and scope of the claims.

What is claimed is:

1. A method of assembling a turbine bucket having a dovetail portion, an airfoil portion, and a root that extends between the airfoil portion and the dovetail portion, the turbine bucket including a pressure side and a suction side that are connected together at a leading edge and a trailing edge, said method comprising:

forming at least one pocket within the turbine bucket, such that the pocket is formed within the pressure side and such that the pocket includes an adhesion area;

forming at least one pin within the at least one pocket; and applying a fill material to the adhesion area such that the fill material is bonded within the at least one pocket.

2. A method in accordance with claim 1 wherein the pressure side is concave and the suction side is convex.

3. A method in accordance with claim 2 further comprising applying the fill material across the at least one pin.

4. A method in accordance with claim 2 wherein applying the fill material to the adhesion area further comprises applying the fill material such that the at least one pin facilitates distributing shear stresses induced to the adhesion area.

5. A method in accordance with claim 2 wherein said applying a fill material to the adhesion area further comprises bonding at least one of a polyimide material, a polymeric resin material including glass fibers, a carbon material structure, and an organic fiber produced from poly-paraphenylene terephthalamide materials within the at least one pocket.

6. A method in accordance with claim 2 further comprising selecting the fill material based on the operating characteristics of a turbine engine.

7. A bucket for a steam turbine, said bucket comprising:

a dovetail portion;

an airfoil portion; and a root extending between said dovetail portion and said airfoil portion, said airfoil portion comprising a first surface and a second surface connected together at a leading edge and a trailing edge, one of said first surface and said second surface comprises at least one pocket defined therein, at least one pin is formed within said at least one pocket, said airfoil portion is substantially solid between said first surface and said second surface.

8. A steam turbine bucket in accordance with claim 7 wherein said first surface is concave and said second surface is convex, said at least one pocket is defined within said first surface.

9. A steam turbine bucket in accordance with claim 7 wherein said at least one pocket further comprises an adhesion area, said bucket further comprises a fill material formed within said at least one pocket and bonded to said adhesion area.

10. A steam turbine bucket in accordance with claim 9 wherein said at least one pin facilitates increasing bonding of said fill material within said at least one pocket.

11. A steam turbine bucket in accordance with claim 9 wherein said at least one pin is configured to distribute shear stresses induced to said bucket within said adhesion area.

12. A steam turbine bucket in accordance with claim 9 wherein said fill material comprises at least one of a polyimide material, a polymeric resin material including glass fibers, a carbon material structure, and an organic fiber produced from poly-paraphenylene terephthalamide materials.

13. A steam turbine bucket in accordance with claim 9 wherein said fill material is selected based on the operating characteristics of the turbine engine.

14. A steam engine comprising:

at least one bucket comprising:

a dovetail portion;

an airfoil portion; and a root extending between said dovetail portion and said airfoil portion, said airfoil portion comprising a first surface and a second surface connected together at a leading edge and a trailing edge, one of said first surface and said second surface comprises at least one pocket defined therein, at least one pin is formed within said at least one pocket.

15. A steam engine in accordance with claim 14 wherein said first surface is concave and said second surface is convex, said at least one pocket is defined within said first surface.

16. A steam engine in accordance with claim 14 wherein said pocket further comprises an adhesion area, said bucket further comprises a fill material formed within said at least one pocket and bonded to said adhesion area.

17. A steam engine in accordance with claim 16 wherein said at least one pin facilitates increasing bonding of said fill material within said at least one pocket such that shear stresses induced to said bucket within said adhesion area are distributed.

18. A steam engine in accordance with claim 16 wherein said fill material comprises at least one of a polyimide material, a polymeric resin material including glass fibers, a carbon material structure, and an organic fiber produced from poly-paraphenylene terephthalamide materials.

19. A steam engine in accordance with claim 16 wherein said fill material is selected based on the operating characteristics of the turbine engine.

* * * * *